US005415832A

United States Patent [19]

Friborg et al.

[11] Patent Number: 5,415,832

[45] Date of Patent: May 16, 1995

[54] METHOD OF MANUFACTURING MOULDINGS

[75] Inventors: Sigurd Friborg, VästerÅs; Kurt Lill, Surahammar; Krister Torssell, Söderbärke, all of Sweden

[73] Assignee: Asea Brown Boveri AB, Västeras, Sweden

[21] Appl. No.: 940,863

[22] PCT Filed: Feb. 25, 1991

[86] PCT No.: PCT/SE91/00143

§ 371 Date: Oct. 30, 1992

§ 102(e) Date: Oct. 30, 1992

[87] PCT Pub. No.: WO91/12911

PCT Pub. Date: Sep. 5, 1991

[30] Foreign Application Priority Data

Mar. 1, 1990 [SE] Sweden ..... 9000732

[51] Int. Cl.[6] ..... B22F 1/00

[52] U.S. Cl. ..... 419/49; 419/42

[58] Field of Search ..... 419/42, 49, 68; 264/314, 316, 337, 109

[56] References Cited

U.S. PATENT DOCUMENTS

Re. 31,355 8/1983 Rozmus ..... 419/49

2,725,288 11/1955 Dodds et al. ..... 75/226

2,943,933 7/1960 Lenhart ..... 75/214

4,389,362 6/1983 Larsson ..... 264/111

4,601,878 7/1986 Aslund et al. ..... 419/49

*Primary Examiner*—Donald P. Walsh

*Assistant Examiner*—Anthony R. Chi

*Attorney, Agent, or Firm*—Watson, Cole, Grindle & Watson

[57] ABSTRACT

This invention relates to a method of manufacturing a plurality of molded parts by the steps of (a) providing a plurality of subelements, at least one of said subelements being formed by compression moulding of a sheet so as to define a plurality of recesses therein; (b) welding said subelements together to provide a deformable composite capsule in which said recesses define an inlet channel communicating with a plurality of moulding chambers for forming a plurality of moulded parts; (c) passing powdered material through said inlet channel in said capsule to fill said plurality of moulding chambers therein; (d) evacuating said capsule and essentially sealing said inlet channel; (e) isostatically compacting said capsule to form an essentially dense body therein comprising a plurality of interconnected moulded parts, and (f) separating said moulded parts from one another and cleaning them away from said inlet channel.

2 Claims, 2 Drawing Sheets

METHOD OF MANUFACTURING MOULDINGS

BACKGROUND OF THE INVENTION

The invention relates to a method of manufacturing mouldings from powder material wherein the powder material is filled into preformed capsules, which are thereafter evacuated and gas-tightly sealed before being compacted into essentially dense bodies by isostatic pressing. The invention is especially applicable to the manufacture of mouldings with small individual weights or in large series.

When compacting powder material by means of isostatic pressing, the powder material is enclosed in a deformable, gas-tight capsule before the isostatic pressure is applied to the body from a surrounding pressure medium.

The body is formed, for example by filling powder into a preformed capsule, but the powder may also be preformed into a green body from which binder (if any) is driven off before the body is coated with a dense, encapsulating layer.

In the manufacture of metallic bodies by isostatic pressing, the metal powder is usally filled into a preformed thin sheet capsule. The costs of manufacturing the sheet metal capsule limits the application of isostatic pressing since the relative importance of the mould costs for the total cost of the mouldings increases with decreased individual weight, with reduced alloying content, and with an increasingly complex shape, but remains essentially unaffected by the length of the series. The cost picture which arises when each moulding requires a seal-welded and pressure-tested capsule restricts the possibilities of using isostatic pressing, especially when manufacturing mouldings with small individual weights, a complex shape, or low material costs.

SUMMARY OF THE INVENTION

When manufacturing mouldings by isostatic pressing of powdered material in a deformable capsule, according to the present invention at least one sub-element is preformed by compression moulding of thin sheet, with recesses. The capsule is joined, by means of welding, from the preformed sub-elements into a capsule, at least one of the recesses in the preformed sub-element forming a mould for a moulding part and at least one additional recess in the preformed sub-element forming an inlet channel for the powder material. The capsule is filled with powder material and is evacuated and sealed in an essentially gas-tight manner, after which the capsule with powder material enclosed therein is isostatically compacted into an essentially dense body.

After the compaction, the capsule is removed and the moulding parts are separated from each other and cleaned from the inlet channels.

Since the sub-elements are preformed and joined together by mechanizable technique, compression moulding of thin sheet and welding, possibilities are provided for manufacturing considerably more complex capsules which, in addition to the mould for the mouldings, may also contain inlet channels for the powder. This makes it possible to manufacture a large number of mouldings in the same capsule. In addition, the application of mechanizable technique results in a reduction of the costs of the capsule with increasing lengths of series.

The manufacture of capsules according to the invention in which compression moulding of sheet is utilized for forming the capsule means that the lower economic limit to the individual weight is removed and that capsules can now be manufactured which contain a large number of moulds, that more complicated shapes can be manufactured in an economic way, that the fact that the costs per capsule decrease with increasing series lengths can be taken advantage of, and that the testing cost per capsule, for capsules containing several moulds, can be spread over a larger number of parts.

For example, the invention makes it possible to manufacture blanks for turbine blades, the properties of which have been improved by isostatic pressing, without the high costs associated with conventional capsule manufacture.

BRIEF DESCRIPTION OF THE DRAWINGS

The invention will be explained in greater detail with reference to the accompanying drawings, wherein FIG. 1 schematically shows the manufacture of mouldings according to the invention

DESCRIPTION OF THE PREFERRED EMBODIMENTS

Figure 1:
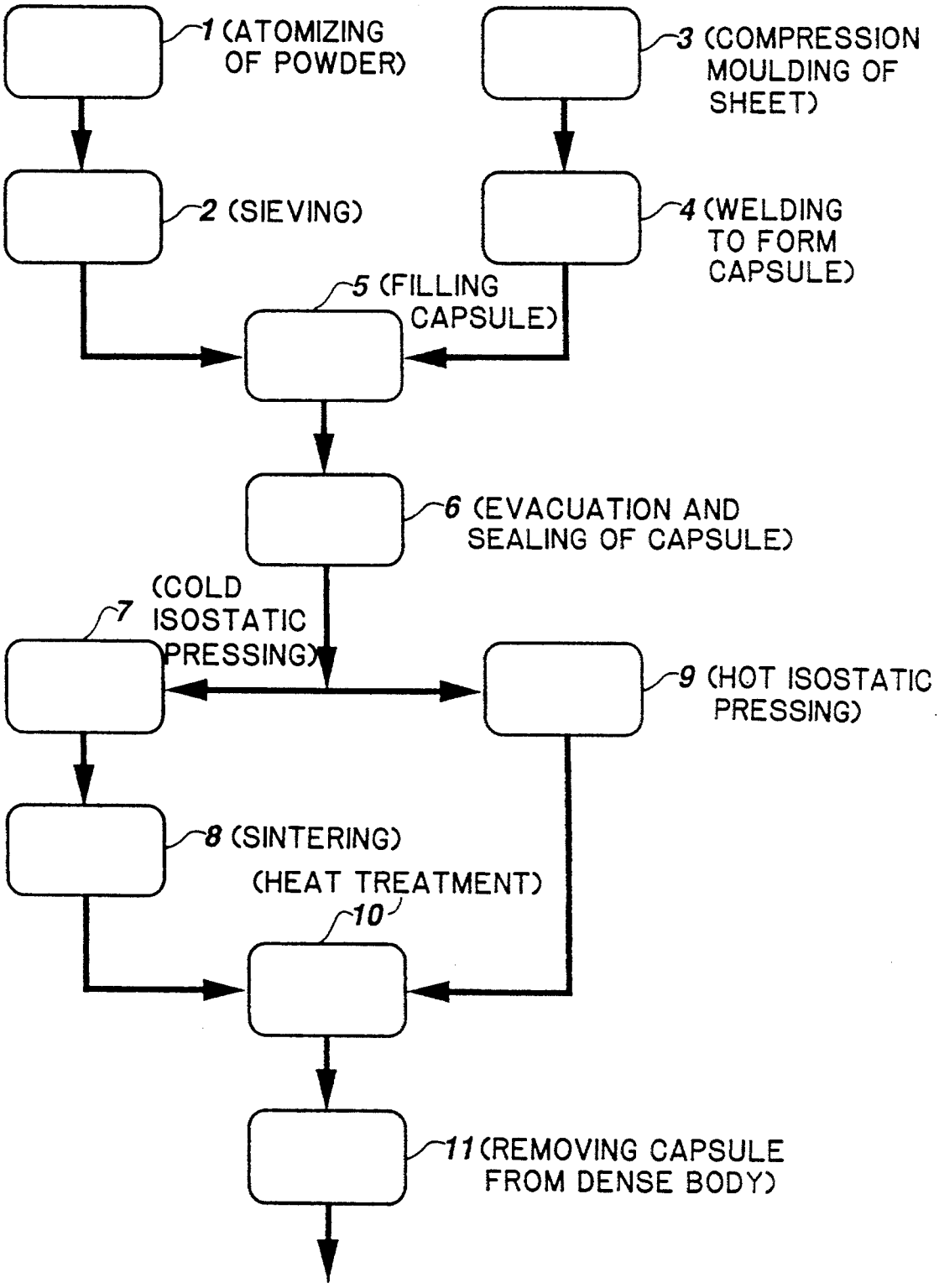

The manufacture of mouldings according to the invention is schematically shown in FIG. 1. However, the manufacture of mouldings of course comprises also a plurality of other steps, conventional in powder metallurgical manufacture of mouldings and not specified below, for ensuring and inspecting the quality of the produced parts or for obtaining the desired material properties, which steps are taken during and after the described process. For example, in a conventional manner steps such as heat treatment, surface treatment and adjustment of dimensions and shapes by mechanical machining are taken both between the described process stages and thereafter.

The metal powder which is necessary for the manufacture of mouldings according to the invention is manufactured and prepared by conventional methods, in FIG. 1 exemplified by gas atomizing at 1 supplemented with sieving at 2 to obtain a suitable distribution of grain size. It is self-evident that powdered materials can be manufactured or prepared by other methods as well.

To form the powder, a capsule 20 is manufactured by shaping and gas-tightly joining sub-element 21 by means of compression moulding at 3 and welding at 4, respectively. Other forming and joining techniques are, of course, also conceivable; however, mechanizable methods are preferred. A particularly preferred method for forming the sub-elements 21 is compression moulding of thin plate by fluid cell technique.

Figure 2:
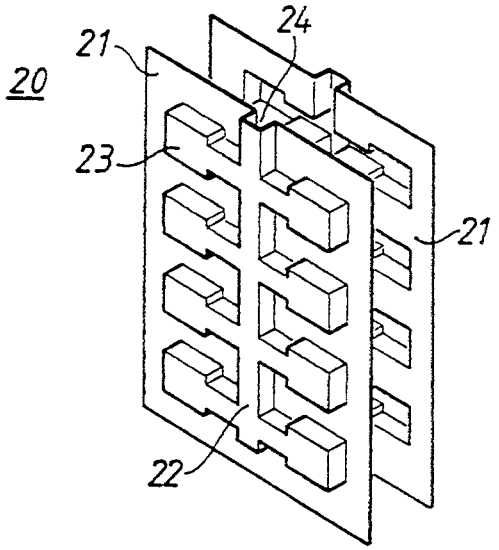
FIGS. 2 to 4 show examples of capsules and sub-elements for capsules which have been preformed and joined together according to the invention.
Figure 3:
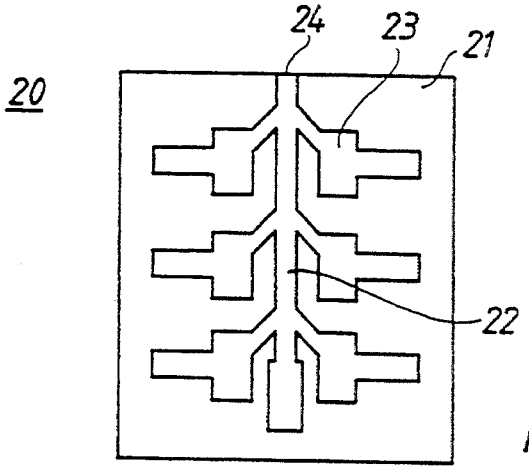
Figure 4:
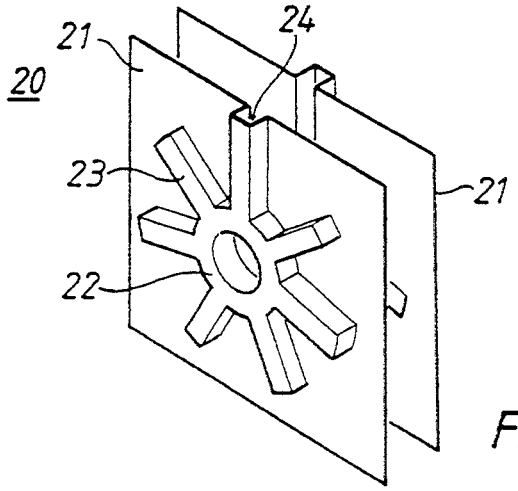

According to the invention, the sub-elements 21 (see FIGS. 2 through 4) are formed with recesses 22, which in the assembled capsule 20 form moulds 23 for at least one moulding part and inlet channels 24 for the metal powder. In this way it is possible to form and compact a large number of small parts in the same capsule, which greatly reduces both the manufacturing cost and the testing cost for each part. Since the sub-elements 21 included in the capsule 20 are formed and joined by means of mechanizable technique and since one capsule may constitute a mould for a large number of moulding parts, the lower economic limit to the individual weight is removed while at the same time obtaining reduced costs with increasing series lengths. In addition, the forming of the sub-elements 21 by pressing of thin sheet provides increased possibilities of producing also complicated moulding parts at reasonable costs in case of large series.

The metal powder is filled at 5 into the assembled capsule 20, which is evacuated and gas-tightly sealed, suitably by welding at 6, before it is compacted by isostatic pressing. The compaction can be performed both by cold isostatic pressing at 7, with subsequent sintering in the furnace 8, and by hot isostatic pressing at 9 during simultaneous sintering and compaction. Hot isostatic pressing is preferably performed at a temperature of 1000°–1300° C. and a pressure of at least 100 MPa.

After compaction at 7, 9 and any subsequent heat treatment at 10, the capsule 20 is removed at 11 in conventional manner, mechanically by blasting or chemically by pickling, whereupon the moulding parts are separated from one another and cleaned from inlet channels by a suitable method, for example by machining by cutting or gas cutting.

We claim:

1. A method of manufacturing a plurality of moulded parts by the steps of:

(a) providing a plurality of subelements, at least one of said subelements being formed by compression moulding of a sheet so as to define a plurality of recesses therein;

(b) welding said subelements together to provide a deformable composite capsule in which said recesses define an inlet channel communicating with a plurality of moulding chambers for forming a plurality of moulded parts;

(c) passing powdered material through said inlet channel in said capsule to fill said plurality of moulding chambers therein;

(d) evacuating said capsule and essentially sealing said inlet channel;

(e) isostatically compacting said capsule to form an essentially dense body therein comprising a plurality of interconnected moulded parts, and (f) separating said moulded parts from one another and cleaning them away from said inlet channel.

2. A method according to claim 1, wherein in step (d) the capsule is compacted at 1000°–1300° C. and a pressure of at least 100 MPa.

* * * * *